United States Patent [19]

Herzel et al.

[11] Patent Number: 4,503,771

[45] Date of Patent: Mar. 12, 1985

[54] MECHANISM FOR ENGAGING, DISENGAGING AND ADJUSTING APPLICATOR ROLLERS WITH RESPECT TO THE PLATE CYLINDER OF PRINTING MACHINES

[75] Inventors: Joachim Herzel, Frankfurt am Main; Claus Simeth, Offenbach am Main; Rudolf Mitze, Dietzenbach; Robert Ortner, Alzenau/Michelbach, all of Fed. Rep. of Germany

[73] Assignee: M.A.N. Roland Druckmaschinen Aktiengesellschaft, Offenbach am Main, Fed. Rep. of Germany

[21] Appl. No.: 471,502

[22] Filed: Mar. 2, 1983

[30] Foreign Application Priority Data

Mar. 3, 1982 [DE] Fed. Rep. of Germany ..... 3207622

[51] Int. Cl.[3] ..... B41F 13/36

[52] U.S. Cl. ..... 101/247; 101/352; 101/216

[58] Field of Search ..... 101/209, 352, 247, 349, 101/216, 248

[56] References Cited

U.S. PATENT DOCUMENTS

| | | | |
|---|---|---|---|
| 2,568,761 | 9/1951 | Peyrebrune | 101/247 X |
| 2,751,843 | 6/1956 | Faeber | 101/352 X |
| 2,853,943 | 9/1958 | Royer | 101/352 X |
| 2,986,086 | 5/1961 | Siebke | 101/247 X |
| 3,448,686 | 6/1969 | Bohman | 101/349 |
| 3,691,956 | 9/1972 | James et al. | 101/352 X |
| 4,094,243 | 6/1978 | Braun | 101/349 |
| 4,369,705 | 1/1983 | Gelinas | 101/247 X |
| 4,373,442 | 2/1983 | Dahlgren et al. | 101/209 X |
| 4,407,198 | 11/1983 | Simeth | 101/248 |

FOREIGN PATENT DOCUMENTS

| | | |
|---|---|---|
| 2627963 | 11/1977 | Fed. Rep. of Germany . |
| 1207833 | 2/1960 | France . |
| 231504 | 3/1944 | Switzerland . |
| 484748 | 12/1967 | Switzerland . |

*Primary Examiner*—Clifford D. Crowder

*Attorney, Agent, or Firm*—Leydig, Voit, Osann, Mayer & Holt, Ltd.

[57] ABSTRACT

For the rapid simultaneous engagement, disengagement and adjustment of all the applicator rollers at the plate cylinder of a printing machine, cam discs are mounted on the journals independently of the plate cylinder bearing. In an offset printing machine, the inking and damping rollers are each associated with their own cam discs. The cam discs are pivotable by means of drives, about the journals, with respect to adjustable stops for the engagement positions and end stops for the disengaged positions of the applicator rollers. The applicator rollers are mounted on rocker arms with respect to the stationary axis of the distributors preceding the applicator rollers and are adjustable with respect to the plate cylinder through the agency of adjustment means which co-operate with the cam discs. Adjustment of the applicator rollers during operation is effected by way of the cam discs which, in addition to the disengagement lobes, have cam zones for the roller engagement and adjustment.

4 Claims, 9 Drawing Figures

MECHANISM FOR ENGAGING, DISENGAGING AND ADJUSTING APPLICATOR ROLLERS WITH RESPECT TO THE PLATE CYLINDER OF PRINTING MACHINES

Engagement, disengagement and adjustment means are required to enable the applicator rollers to be appropriately engaged with and disengaged from the plate cylinder at the start and end of printing. The geometry, more particularly the center-to-center distances between the applicator rollers and the plate cylinder, must be maintained for constant operating conditions to enable the inking and the damping of the printing plate to be controlled. The adjustment of the rolling conditions of the applicator rollers must also be maintained if the operating conditions change or a malfunction necessitates an interruption to the printing operation.

Mechanisms of this kind are already known. For example, French Pat. No. 1 207 883 describes a mechanism whereby the applicator rollers can be jointly engaged with or disengaged from the plate cylinder. For this purpose it contains an annular cam disc which is mounted centrally with respect to the plate cylinder axis on an extension of the eccentric plate cylinder bearing. The cam disc can be turned through a limited angle by means of a linkage, spacers between the cam disc and the applicator rollers following the shape of the cam. Also, the applicator rollers can be adjusted in respect of their position in relation to the plate cylinder. This is possible by means of wedge elements and adjustment screws mounted in the printing machine housing.

Swiss Pat. No. 231 504 describes a mechanism for disengaging applicator rollers in rotary printing machines. In this case the applicator rollers are engageable and disengageable by way of a cam plate mounted centrally with respect to the plate cylinder axis on a part of the plate cylinder bearing. The applicator rollers are mounted in forks which are in turn secured to rocking plates mounted in the machine housing. The forks allow radial and tangential adjustments of the applicator rollers with respect to the plate cylinder.

German Pat. No. 2 627 963 also describes a mechanism in printing machines for adjusting the applicator rollers with respect to the plate cylinder. It comprises a support disc secured on the plate cylinder bearing centrally with respect to its adjustment eccentric. The support disc has camming segments which compensate for the eccentric movement of the plate cylinder with respect to the applicator rollers by the pivoting movement of the support disc.

Finally, Swiss Pat. No. 484 748 describes an inking or damping mechanism whereby applicator rollers in printing machines can be adjusted with respect to the plate cylinder. To this end, a spiral regulating disc is disposed on each applicator roller the adjustment with respect to the plate cylinder being located by the position of the discs with respect to arcuate segments on a fixed member on the plate cylinder axis. The adjustment of the regulating disc has to be carried out only once for an applicator roller and is maintained on any change of applicator roller.

All the mechanisms indicated have the disadvantage that routine incidents such as roller wear, changes of rollers, variation in covering thickness of the plate cylinder, or any change in the rolling conditions of the applicator rollers, necessitate manual adjustment of the roller setting. In addition, the adjustment mechanisms are either of complicated construction or do not allow exact adjustment of the applicator rollers. Thus the means required for the adjustment of the applicator rollers in the French Pat. No. 1 207 883 are very expensive, since each applicator roller requires two wedge elements with an associated adjusting screw and, in addition, a spacer.

In the mechanism described in Swiss Pat. No. 484 748, the purpose described requires a new adjustment mechanism for each applicator roller used, and in addition these adjustment mechanisms can be operated only inside the machine housing. Finally, the applicator rollers cannot be disengaged jointly in this case.

Swiss Pat. No. 231 504 again describes a very expensive mechanism for adjusting the applicator rollers. The adjustment must again be carried out separately. In addition, this type of mounting is unsuitable for exact location of the rolling conditions of the applicator rollers.

German Pat. No. 2 627 963, which describes the mechanism, finally offers no possibility of disengaging the applicator rollers from the plate cylinder independently of the plate cylinder adjustment, since the support disc for the readjustment of the applicator rollers is rigidly connected to the plate cylinder eccentric bearing.

A common feature of all the mechanisms is that they allow an inclination of the plate cylinder, of the kind that may be necessary for register corrections, in conjunction with the eccentric bearings without any appreciable change of the rolling conditions. However, a movement of the plate cylinder inside the eccentric bearings for register correction purposes is not possible, since the mechanisms, which define the center-to-center distance between the plate cylinder and the applicator rollers, are all connected to the plate cylinder mounting. As a result, the relative arrangement between the plate cylinder and the applicator rollers would inadmissibly change in the event of inclination of the plate cylinder inside its eccentric bearings.

The object of the invention, therefore, is to provide a structurally simple mechanism whereby variations in the center-to-center distance between the plate cylinder and the associated applicator rollers can be effected simultaneously for all the applicator rollers, the latter being jointly and remote-controllably adjustable in their engaged position with respect to the plate cylinder, and also engageable and disengageable, and allowing a movement of the plate cylinder with respect to its mounting without producing any appreciable changes in the rolling conditions between the applicator rollers and the plate cylinder.

To this end, according to the invention, the cam discs have camming zones for simultaneous adjustment of the center-to-center distance of all the applicator rollers with respect to the plate cylinder in the region of an engagement position and as far as a disengagement position and the cam discs are pivotable with respect to end stops and adjustable stops.

The annular cam discs are disposed on the plate cylinder journal so as to be rotatable about the plate cylinder axis. Their mounting is independent of the plate cylinder mounting, which is also required to allow movement of the journal inside the eccentric bearing. The damping and inking rollers each have their own cam discs on either side of the plate cylinder. The applicator rollers themselves are mounted in rocker arms provided with compression springs and adjustment means for adjustment of the applicator roller engagement. The adjustment means co-operate with the associated cam discs. The rocker arms are pivotable about the axes of the distributor rollers situated directly in front of the applicator rollers in the roller train.

The resulting arrangement enables the most widely varying operating conditions to be accommodated. Any variation in plate cylinder covering no longer requires the complex adjustment of all the applicator rollers individually, but only the remote-controlled adjustment of the stops for the adjustment positions of the corresponding cam discs. The adjustment for any change in rolling conditions or on a change of a complete set of applicator rollers can also be carried out for all the applicator rollers jointly to some extent. The separate adjustment of individual applicator rollers is necessary only in the event of considerable diameter changes or a change of individual rollers. The specific advantage is that the adjustment can be carried out rapidly and be automated and requires no tedious manual labour inside the machine housing. The applicator roller mounting is of very simple construction and the rolling conditions of the applicator rollers can also be adjusted controllably and, if necessary, unsymmetrically.

The arrangement is also very advantageous when plate cylinders have to be inclined with respect to the associated blanket cylinder by movements inside the plate cylinder eccentric bearing. An inclination of this kind should produce only minor changes in printing pressure between the plate cylinder and the blanket cylinder co-operating therewith. The mechanism according to the invention permits this inclination with very minor variations in the rolling conditions between the plate cylinder and the applicator rollers, and these variations do not affect the operating conditions. The basic adjustment of the applicator rollers can be automatically restored allowing for all diameter variations or variations in the operating conditions, even after a machine stoppage. The mechanism is of simple construction generally and very flexible in respect of adaptation to variations in operating conditions. On exemplified embodiment of the mechanism according to the invention will be described hereinafter and is illustrated in the diagrammatic drawings wherein:

Figure 1:
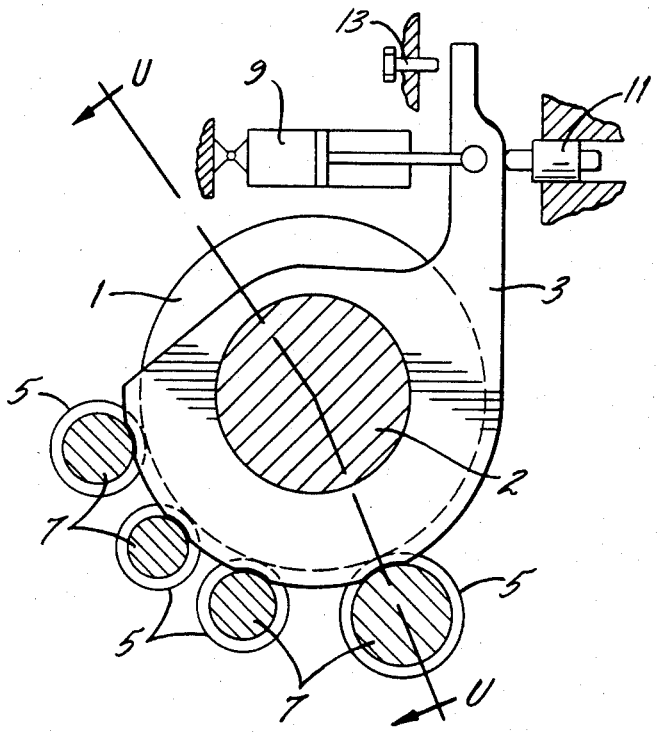
FIG. 1 illustrates the inking rollers and their mechanism for adjustment with respect to the plate cylinder.
Figure 2:
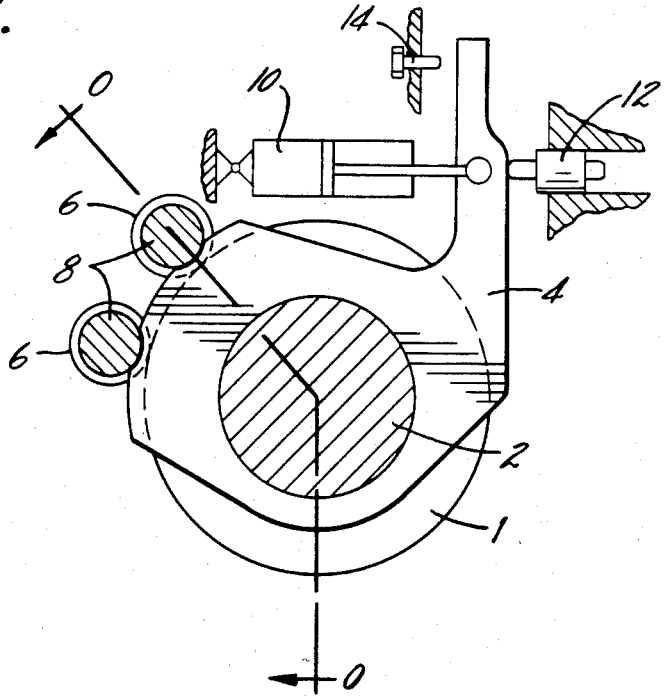
FIG. 2 illustrates the damping rollers and their mechanisms for adjustment with respect to the plate cylinder.

The plate cylinder of an offset printing machine is shown here as an example. FIGS. 1 and 2 are sections through the mounting of the plate cylinder 1. The cam disc 3 is mounted centrally on journal 2 in order to control the inking rollers 5. Cam disc 3 co-operates with the centering means 7 (illustrated diagrammatically) of the inking rollers 5. The drive for pivoting the cam disc consists of a hydraulic or pneumatic cylinder 9, the piston rod of which engages an extension of the cam disc 3. An adjustable stop 11 and an end stop 13 are associated with the said extension of the cam disc 3. Stop 11 is used to locate the position in which the inking rollers 5 are in contact with the plate cylinder 1. The end stop 13 is used to locate the released position of the inking rollers 5. Thus in order to bring the inking rollers 5 into and out of engagement the drive movement is performed only between the said two stops 11, 13.

FIG. 2 shows the corresponding relative arrangement of the damping rollers 6 and their adjusting means 8 to the plate cylinder by way of the cam disc 4 on the journal 2. The associated drive consists of a pneumatic or hydraulic cylinder 10, an adjustable stop 12 for locating the engaged position and an end stop 14 for locating the disengaged position of the damping rollers 6.

Figure 3A:
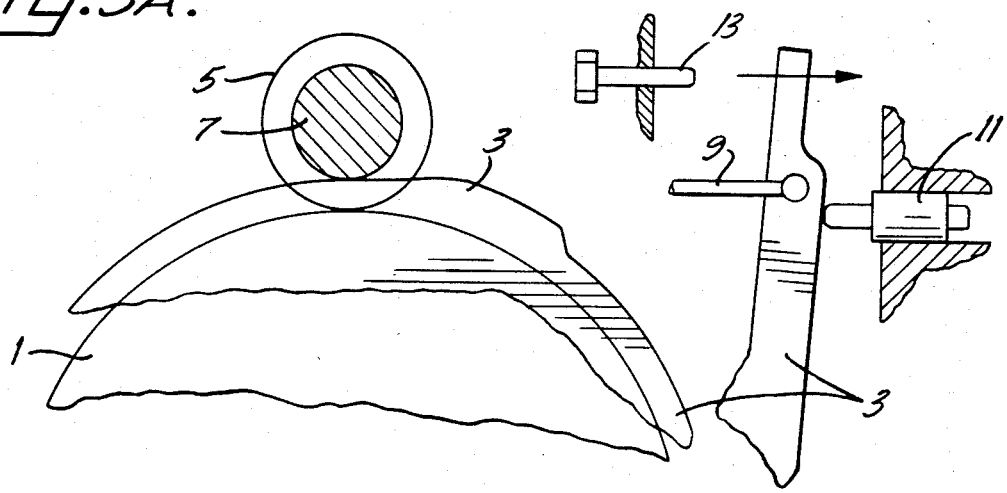
FIGS. 3A, 3B and 3C illustrate the geometric relationships between the applicator roller, the cam disc and the plate cylinder for different operating conditions.

The configuration of the cams of the cam discs 3 and 4 defines the adjustment of the inking and damping rollers 5, 6 respectively. FIG. 3 shows three positions diagrammatically. FIG. 3A shows an adjustment for a normal plate cylinder covering and worn applicator rollers or possibly applicator rollers of reduced diameter.

The stop 11 for locating the engaged position is to be drivable. It has been retracted and enables the cam disc 3 to pivot by means of the drive 9 to an extent such that the adjusting means 7 for the inking roller 5 abut the cam disc 3 at a zone thereof which is sufficiently close to the plate cylinder axis to enable the inking rollers 5 to be engaged with the plate cylinder 1 as required.

Figure 3B:
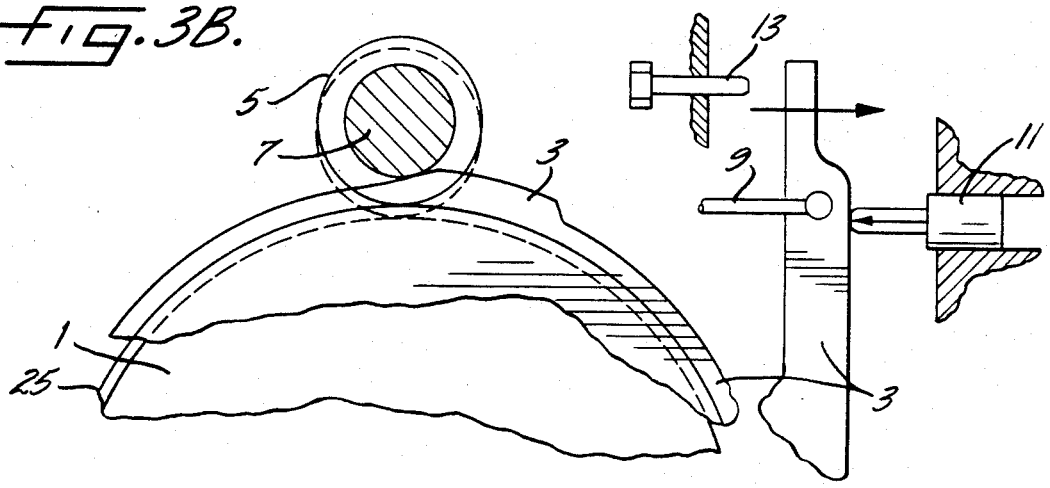

If the plate cylinder covering is now increased as indicated by circle 25, e.g. in order to adjust the length of the print, or if larger-diameter inking rollers 5 are used, the center-to-center distance between the inking roller 5 and the plate cylinder 1 must be increased. To this end, as shown in FIG. 3B, the stop 11 is extended towards the cam disc 3. Consequently cam disc 3 cannot be pivoted as far and the adjustment means 7 of the inking rollers 5 engage a point of the curve farther away from the plate cylinder axis. The required adjustment between the inking roller 5 and the plate cylinder 1 can again be maintained simply by pivoting the cam disc 3.

Figure 3C:
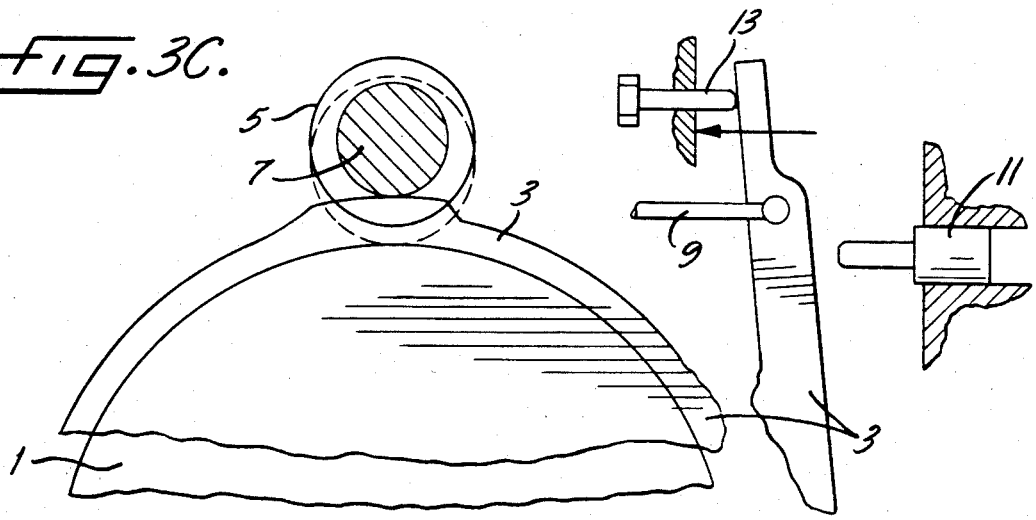

To disengage the inking roller 5, cam disc 3 is pivoted against the end stop 13 as shown in FIG. 3C. End stop 13, which locates the position of the disengagement lobe on the cam disc 3 with respect to the adjusting means 7 for the inking rollers 5, is normally adjusted just once. It is therefore logical to make it manually operable, since it is required only on installation.

The broken lines in FIGS. 3B and 3C illustrate the basic position from FIG. 3A. The adjustment of the inking roller 5 with the cam disc 3 applies equivalently to all the other applicator rollers 5, 6 and the associated cam discs 3, 4. Two identical adjustment systems 3, 4, 9–14 are required in each case for both the damping unit and the inking unit on an offset printing machine.

Figure 4:
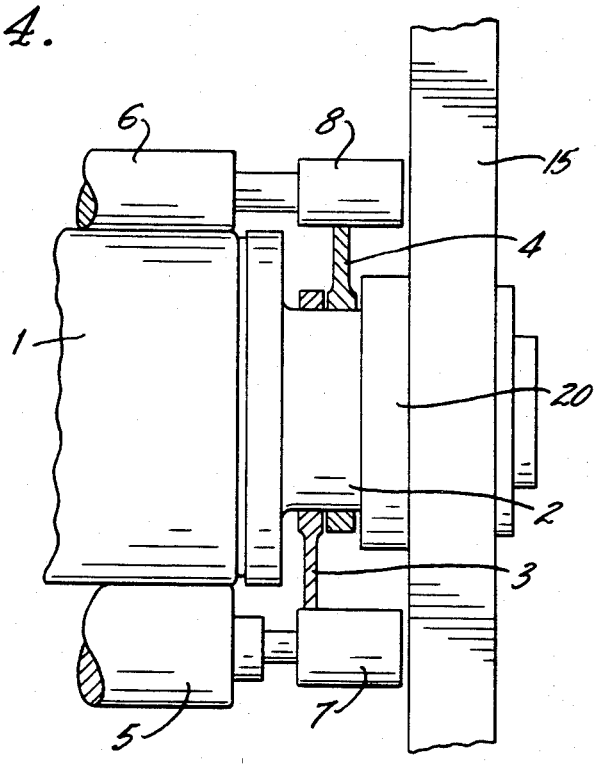
FIG. 4 is an axis-parallel section through the adjustment mechanism and the eccentric cylinder mounting.

The position of the cam discs 3, 4 is illustrated in FIG. 4, which is a superimposition of the section O—O in FIG. 2 in the top half and U—U in FIG. 1 in the bottom half. The cam discs 3, 4 are disposed and mounted rotatably on the journal 2 independently of the eccentric bearing 20 of the plate cylinder 1 inside the machine housing. The mounting for the cam discs 3, 4 is not shown in detail. They co-operate with diagrammatically indicated adjustment means 7, 8 on the shafts of the applicator rollers 5, 6. The function of the cam discs, 3, 4 as spacers to locate the center-to-center distance between the applicator rollers 5, 6 and the plate cylinder 1 will be clearly apparent here.

Figure 5:
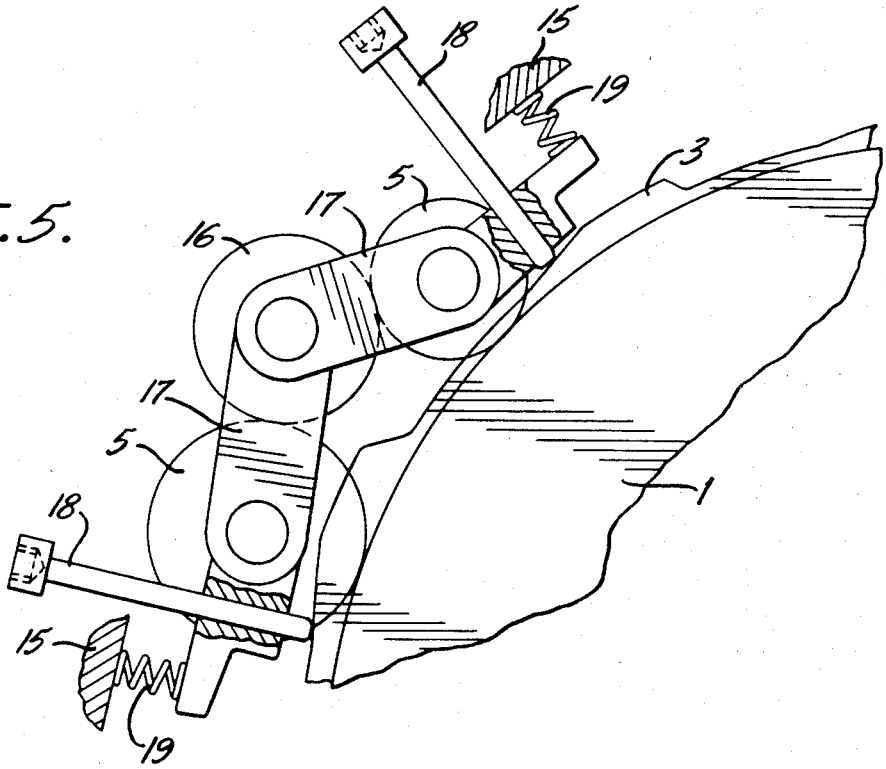
FIG. 5 illustrates the adjustment means for locating the basic adjustment of the applicator rollers.

FIG. 5 shows the construction of the adjustment means 7, 8 in greater detail. For adjustment of the applicator rollers 5, the latter are mounted in rocker arms 17 with respect to the axis of the distributor roller 16. The axis of the distributor roller 16 is stationary in the plane parallel to the machine housing while the axes of the applicator rollers 5 are movable by means of the rocker arms 17. Applicator rollers 5 can be adjusted with a constant center-to-center distance, which is intended to be adjustable by means not shown in greater detail, e.g. eccentrics between the distributor roller 16 and the applicator rollers 5, for movement around the distributor 16 without varying the rolling conditions between the rollers.

Adjusting screws 18 extending through screwthreaded holes in the projections of the bearing arms 17 are provided thereon for adjustment of the inking rollers 5 against the plate cylinder 1. Compression springs 19 are provided between the arms 17 and the housing 15. The compression spring 19 between the housing 15 and the arm 17 presses the screw 18 against the cam disc 3. Thus the applicator rollers 5, 6 are applied against the plate cylinder 1 with a force equivalent to the difference between the spring force and the force by which the screw 18 bears on the cam disc 3. A wide range of adjustment can be obtained by varying the biasing of the compression springs 19. The camming zones of the cam discs 3 must have gradients so designed for respectively corresponding points of contact between the screws 18 and the rollers 5, 6 that rotation of the cam discs 3, 4 produces an identical center-to-center distance variation of both rollers 5, 6 with respect to the plate cylinder 1.

The basic adjustment of the applicator rollers 5, 6 with respect to the plate cylinder 1 is produced by screwing the screws 18 into or out of the arms 17. The compression spring biasing force locks the screws 18 against turning. Thus, starting from the disengaged position, all the applicator rollers 5, 6 can be adjusted to the same level. Re-adjustment is also possible if the roller diameters vary differently for some reason or if any of the applicator rollers have to be replaced. The simultaneous adjustment of all the applicator rollers 5, 6, e.g. to a thicker plate cylinder covering, or to a different roller engagement position is readily and rapidly effected by means of the cam discs 3, 4. The same also applies during operation, in the event of an interruption to the printing operation, for the purpose of disengaging and re-engaging the applicator rollers in the identical engagement position to that applicable before the interruption. All the important alterations during operation can be automated in respect of engagement of the applicator rollers. The applicator rollers can even be engaged more on one side than another, as may be useful for a damping unit, by means of the remote-controlled adjustable stops 11, 12 for the engaged position and the separate drives 9, 10 for the cam discs 3, 4.

Figure 6:
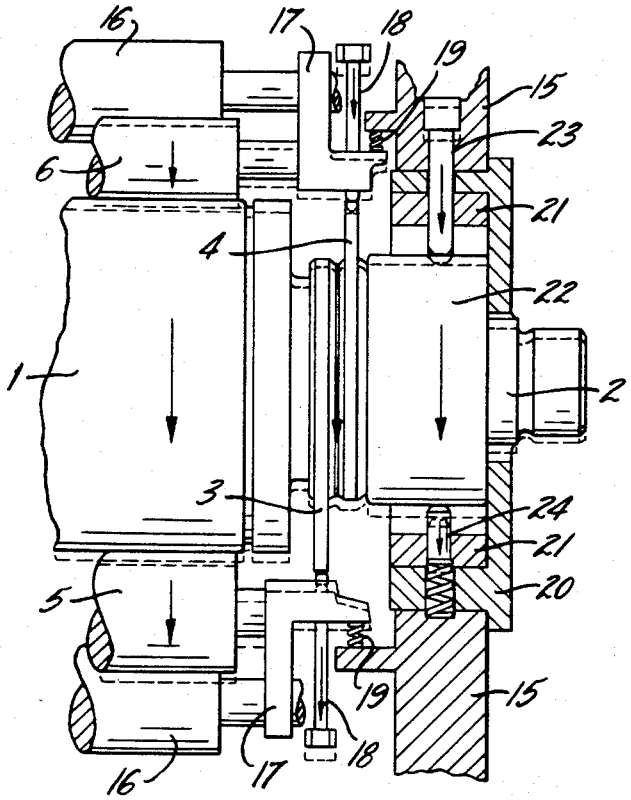
FIG. 6 is an axis-parallel section through the adjustment mechanisms and an adjustable cylinder mounting.

As a result of arranging the cam discs 3, 4 coaxially directly on the journal 2, the engagement of the applicator rollers 5, 6 with the plate cylinder 1 is always extensively maintained. FIG. 6 is an example showing a movement of the journal 2 inside the eccentric mounting 20. The plate cylinder mounting is incorporated into the eccentric bearing and consists of a part 21 which is disposed centrally with respect to the plate cylinder axis and which internally has a rectilinear guide and the actual plate cylinder mounting 22. The latter is flattened at two sides of its periphery and can be moved slightly by the adjustment pin 23 with respect to the spring unit 24 inside the rectilinear guide of part 21. The second plate cylinder bearing (not shown) is of similar construction. By this means, register errors can be obviated by very minor changes of the printing pressure between the plate cylinder 1 and the blanket, by diagonal adjustment of the plate cylinder. On displacement of the plate cylinder 1 along a straight path, the applicator rollers 5, 6 are moved simultaneously by means of the cam discs 3, 4 and the adjustment means 7, 8, this simultaneous displacement being obtained with substantial retention of the rolling conditions. the broken lines in FIG. 6 show the position after the displacement. The distributors 16 are of course fixed in the frame perpendicularly to their axis and accordingly do not participate in the movement. The inking roller 5 is pushed away from the plate cylinder 1 and moves on the rocker arms 17 around the distributor 16. Since the cam disc 3 is, however, situated on the journal 2, the compression spring 19 between the arm 17 and the housing 15 is compressed and the adjusting screw 18, which was not moved during this operation, thus remains in contact with the cam disc 3, i.e., the inking roller 5 is moved on to the same extent as the plate cylinder 1. In these conditions, pivoting of the inking roller 5 towards the stationary axis of the distributor 16 produces a slight peripheral movement of the inking rollers 5 on the plate cylinder and of the adjusting screws on the cam discs 3, as will be explained hereinafter, but results in only a negligible variation of the contact at the inking roller 5. The contact between the damping rollers 6 and the plate cylinder 1 is similarly unaffected in any way influencing printing by the correspondingly opposite movement of the damping roller 6 against the plate cylinder 1 and of the associated adjustment screw 18 at the cam disc 4. The effect is reversed, however, since the damping roller 6 follows the plate cylinder 1 and the adjusting screw 18 follows the movement of the cam disc 4 as a result of the force of the compression spring 19, i.e., the latter expands slightly between the housing 15 and the arm 17. From this aspect, therefore, the damping rollers 6 move around the distributor 16 towards one another.

Figure 7:
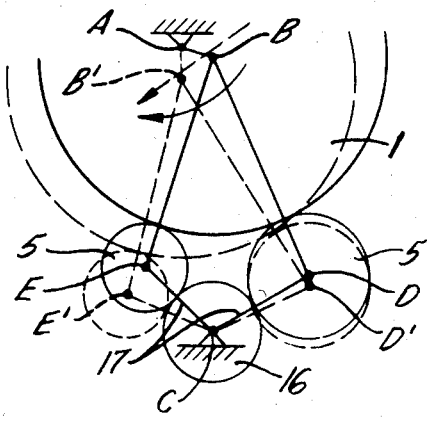
FIG. 7 illustrates the geometric relationships between the applicator rollers and the plate cylinder in response to plate cylinder movements.

Generally, the applicator rollers 5, 6 situated in front of the plate cylinder 1 as considered in the direction of displacement thus pivot apart, while the applicator rollers 5, 6 situated after the plate cylinder 1 move towards one another and the parallel applicator rollers 5, 6 remain stationary. The change in the relative arrangement is shown in FIG. 7 in respect of the printing adjustment by means of the eccentric bearing 20. The adjustment travel has been shown on a highly exaggerated scale. Cylinder center at point B is pivoted to point B′ about bearing center at point A. A rectilinear movement from B to B′ would also be feasible but would give the same initial and final conditions in respect of the geometry. The distributor axis at point C is static. The axes of the applicator rollers 5 at D and E are moved, however, to D′ and E′. The end position is indicated by broken lines. It will readily be seen that the applicator roller 5 nearest the pivoting direction also experiences the greatest displacement, since the distance between E and E′ is greater than the distance between D and D′. The spreading movement of the applicator rollers 5 will also readily be seen. However, it must be remembered that relative movements between the applicator rollers 5, 6 and the plate cylinder 1 of any significance occur, as a result of the eccentric movement, only in the event of any variation in the printing pressure. The applicator rollers are normally also disengaged and engaged with the engagement and disengagement for printing.

In this case, therefore, it is only necessary to take into account the case of the diagonal adjustment of the plate cylinder for the purpose of calculating the displacements by way of example. In a medium-format sheet-fed offset printing machine, the adjustment travel of the journal 2 inside the eccentric bearing 20 is about 0.5 mm at both bearings in respectively opposite directions. Computing such displacement of the plate cylinder 1 in respect of the maximum effect at the applicator roller 5, taking a radius thereof of 30 mm, a distributor with a radius of 40 mm, and a plate cylinder 1 with a radius of 140 mm, gives a tangential displacement of 0.8 mm at the applicator roller 5. Allowing for a 1/40 gradient for the camming zone of the cam disc 3 in respect of the tangential displacement calculated, there is then a radial displacement of 20 μm, i.e., the applicator roller 5 is engaged and disengaged through a travel of 20 μm respectively when being brought into and out of contact with the plate cylinder 1. This is a maximum displacement which hardly occurs in reality, since the applicator rollers 5, 6 are of course distributed approximately over 180° at the periphery of the plate cylinder 1. Even in the event of a displacement of the kind that can occur through the eccentric bearing in response to variations in printing pressure, it can have only minor effects on a roller strip equal to the width of the flattened portion of the engaged roller surface of 10 mm, as produced in applicator rollers having a rubber surface with a roller engagement of about 0.5 mm. They correspond to a widening or narrowing of the roller strip by 0.1 mm in each case. An 0.5% variation in the engagement between the applicator rollers 5, 6 and the plate cylinder 1 as compared with the normal engaged position, as may occur during the diagonal adjustment due to geometry variations, thus results in a maximum 1% change of the roller strip. Thus nothing likely to affect the operation of a printing machine and the printed results is expected.

Various components of the system can advantageously be developed. For example, the end stops 13, 14 for the disengaged position, and the adjusting screws 18 which would in this case be constructed as spring pins, can be made drivable and remove-controlled. The entire adjustment operation can also be inputted to a data bank in accordance with characteristics adapted to the cam discs 3, 4 and the operating conditions, and be kept in readiness for electronic control. In that case it is possible, for example, to re-calculate and automatically compensate for the said effects that the tangential adjustment and, by way of the cam discs, 3, 4, the radial adjustment of the applicator rollers 5, 6 have on the adjustment travel during the plate cylinder adjustment. Similarly, the pivoted travel of the cam discs 3, 4 can be optimized with respect to the position of the disengaging lobe, i.e., the time required for the cam adjustment can be kept as short as possible. The location of the engagement position can then be selected to be as close as possible on the disengagement lobe. Finally, automatic monitoring of the engagement force of the individual applicator rollers by way of the compression springs 19 can also be used to monitor the wear of the applicator rollers 5, 6 and any effects on the printing process, and hence the inking or damping application, can be compensated by controlled readjustment of individual rollers.

We claim:

1. A mechanism for engaging, disengaging and adjusting applicator rollers with respect to the plate cylinder of a printing machine, the plate cylinder being mounted in eccentric bearings in the machine housing and the applicator rollers being adjustable with respect to the plate cylinder by adjustment means and being engageable with and disengageable from the plate cylinder by means of annular cam disks rotatable about the plate cylinder axis, wherein the improvement comprises, in combination, the cam disks have camming zones for simultaneous adjustment of the center-to-center distance of all the applicator rollers with respect to the plate cylinder in the region of a predetermined engagement position and as far as a predetermined disengagement position, the cam disks are pivotable with respect to end stops and adjustable stops, the journal of the plate cylinder is mounted in additional bearing means for allowing a movement with respect to the eccentric bearings, and the annular cam disks are mounted rotatably on the journal of the plate cylinder independently of the eccentric bearing and coaxially of the plate cylinder axis.

2. The mechanism, according to claim 1, wherein the printing machine has inking rollers and dampening rollers and wherein the improvement further comprises the inking rollers and the dampening rollers are each associated with their own respective cam disks and the respective cam disks are each provided with their own respective and separately controllable drives.

3. The mechanism, according to claim 1, wherein the improvement further comprises end stops associated with the cam disks for determining the disengagement position and adjustable stops associated with the cam disks for determining the engagement position, and wherein the stops are adjustable by remote control and can be moved automatically into a base position.

4. The mechanism, according to claim 1, wherein the improvement further comprises the cam disks cooperate with the adjustment means of the applicator rollers, and the adjustment means include bearing arms pivotable about the axes of distributor rollers preceding the applicator rollers, compression springs engage said bearing arms, and said bearing arms are provided with means for adjusting the pivoting of the bearing arms with respect to the cam disks.

* * * * *